US007833048B2

(12) United States Patent
Cheng

(10) Patent No.: US 7,833,048 B2
(45) Date of Patent: Nov. 16, 2010

(54) ELECTRICAL CONNECTOR ASSEMBLY WITH A FFC MODULE

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/383,512

(22) Filed: Mar. 25, 2009

(65) Prior Publication Data

US 2009/0246987 A1 Oct. 1, 2009

(51) Int. Cl.
*H01R 12/24* (2006.01)

(52) U.S. Cl. ..... 439/495

(58) Field of Classification Search ..... 439/495, 439/496, 492

See application file for complete search history.

(56) References Cited

U.S. PATENT DOCUMENTS 4,684,183 A * 8/1987 Kinoshita et al. ..... 439/77
6,159,038 A * 12/2000 Wu ..... 439/495
6,319,052 B1 * 11/2001 Chang ..... 439/495
6,379,161 B1 4/2002 Ma
6,626,698 B2 * 9/2003 Matsumura ..... 439/496
6,699,066 B2 * 3/2004 Wu ..... 439/495
6,916,197 B1 * 7/2005 Wu ..... 439/484
6,951,476 B1 * 10/2005 Saito et al. ..... 439/495
7,140,909 B2 * 11/2006 Moritake ..... 439/492
7,166,803 B2 * 1/2007 Sakurai et al. ..... 439/496
7,238,040 B1 * 7/2007 Wu ..... 439/352
2002/0142647 A1 * 10/2002 Aoki ..... 439/496
2003/0013341 A1 * 1/2003 Urbaniak et al. ..... 439/496

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

An electrical connector assembly comprises an insulative housing defining a receiving cavity extending inwardly from a mating face thereof and a plurality of terminal receiving passages disposed in the insulative housing and in communication with the receiving cavity. A plurality of terminals are received into the corresponding terminal receiving passages. A FFC module defines a pair of FFCs with a pair of first mating portions at one end thereof and an insulative insert having a lower half section disposed between the pair of first mating portions. The FFC module has an inserting portion received into the receiving cavity of the insulative housing.

17 Claims, 5 Drawing Sheets

ELECTRICAL CONNECTOR ASSEMBLY WITH A FFC MODULE

FIELD OF THE INVENTION

The present invention relates to an electrical connector assembly, and more particularly to an electrical connector assembly with a FFC module for mating with two complementary connectors.

DESCRIPTION OF PRIOR ART

Generally, electrical connectors, especially the board-to-board connectors are widely used in some electrical products, such as PC, Mobile phone, PDA etc. Electrically connecting between a pair of PCBs is through two board-to-board connectors, respectively mounted on the pair of PCBs, which are mating with each other. U.S. Pat. No. 6,379,161 B1 is issued to Ma (hereinafter referred to as Ma '161 Pat.) on Apr. 30, 2002 discloses a typical connector of this kind. Please referring to FIGS. 7 to 9 in the above mentioned patent, the Ma '161 Pat. discloses a board-to-board connector defining an insulative housing 20 and two rows of the contacts 12 disposed in the housing 20. The insulative housing 20 defines a slot 22 extending inwardly form a mating face thereof for matably receiving a mating electrical connector or electronic component (not shown) therein. However, at some times, a board-to-board connector needs to mate with two mating electrical connectors or electronic components. So the traditional board to board connector can not meet the demands said above.

As discussed above, an improved electrical connector assembly overcoming the shortages of existing technology is needed.

SUMMARY OF THE INVENTION

Accordingly, an object of the present invention is to provide an electrical connector assembly integrally arranged with a FFC module for mating with two complementary connectors.

In order to achieve the above-mentioned objects, An electrical connector assembly comprises an insulative housing defining a receiving cavity extending inwardly from a mating face thereof and a plurality of terminal receiving passages disposed in the insulative housing and in communication with the receiving cavity. A plurality of terminals are received into the corresponding terminal receiving passages. A FFC module defines a pair of FFCs with a pair of first mating portions at one end thereof and an insulative insert having a lower half section disposed between the pair of first mating portions. The FFC module has an inserting portion received into the receiving cavity of the insulative housing.

Other objects, features and advantages of the invention will be apparent from the following detailed description taken in connection with the accompanying drawings.

DETAILED DESCRIPTION OF PREFERRED EMBODIMENTS

Figure 1:
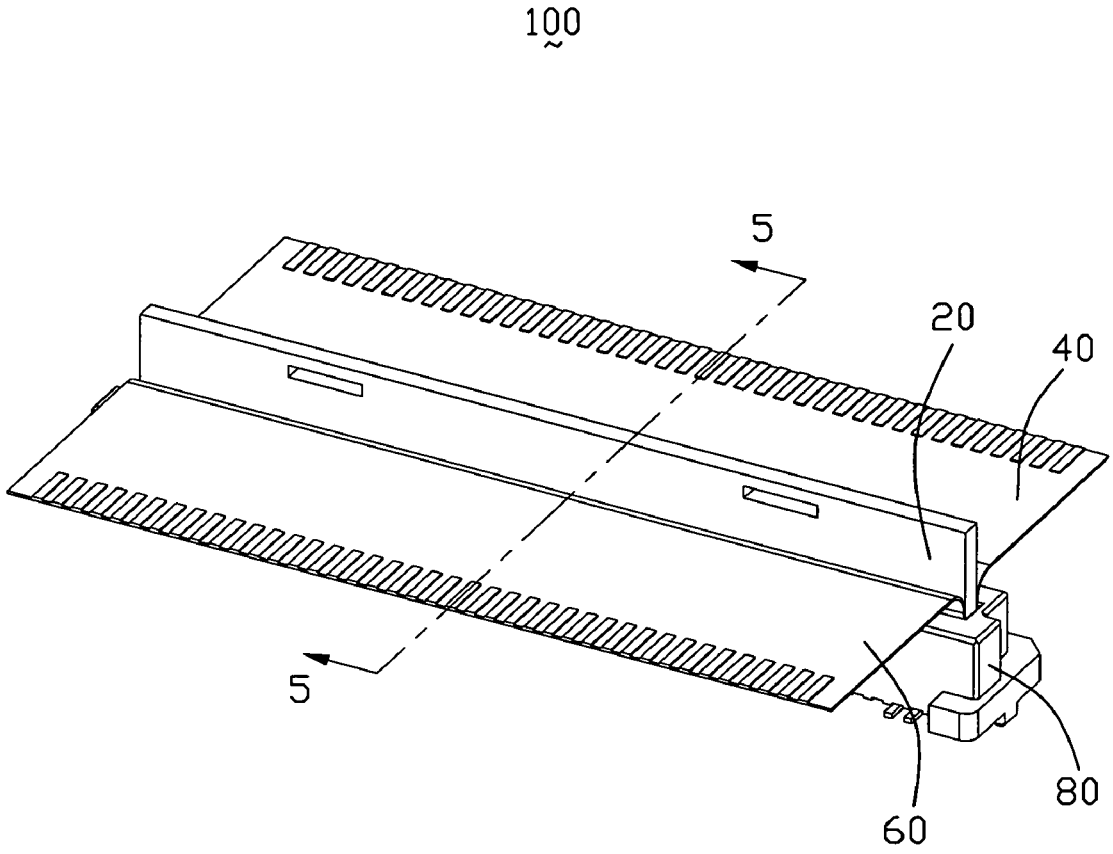
FIG. 1 is a perspective view of an electrical connector assembly in accordance with the present invention.
Figure 2:
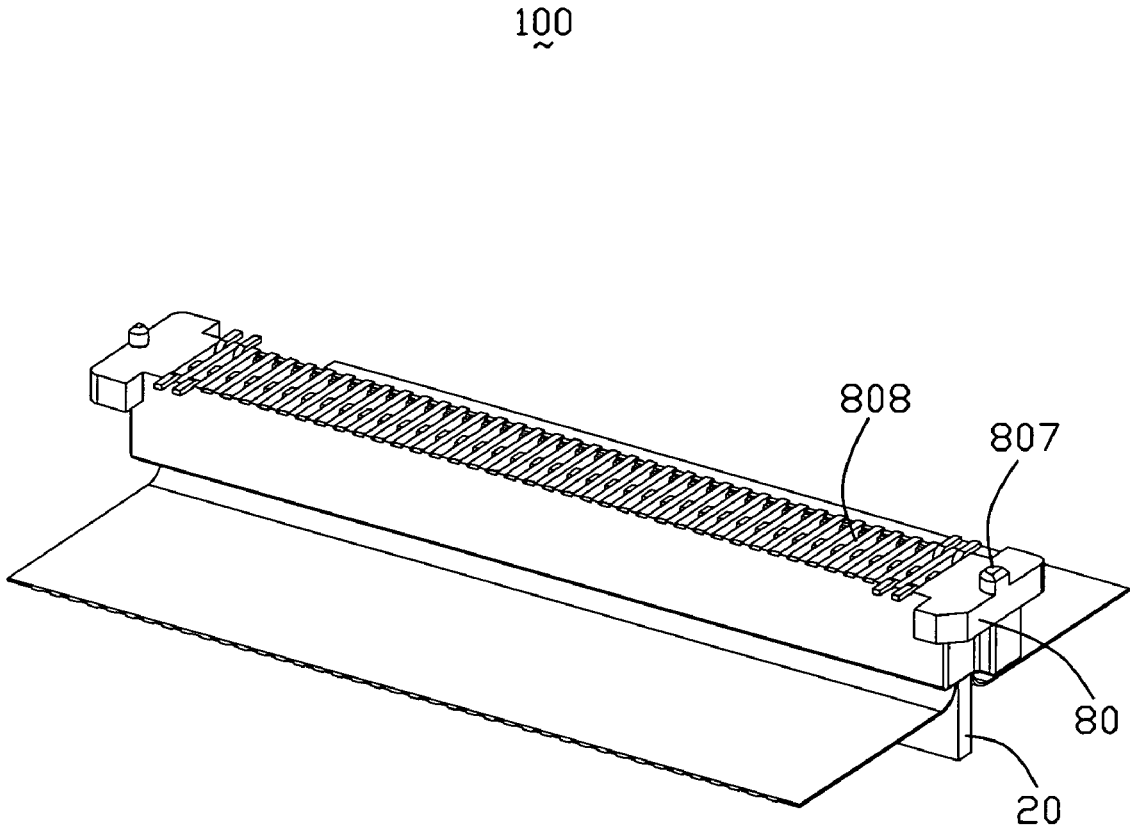
FIG. 2 is a perspective view of the electrical connector assembly in another point of view different from FIG. 1.

Reference will now be made to the drawing figures to describe the present invention in detail.

Referring to FIGS. 1 to 4, an electrical connector assembly 100 in accordance with the present invention includes a board-mount connector and a FFC module connected to the board-mount connector.

Figure 3:
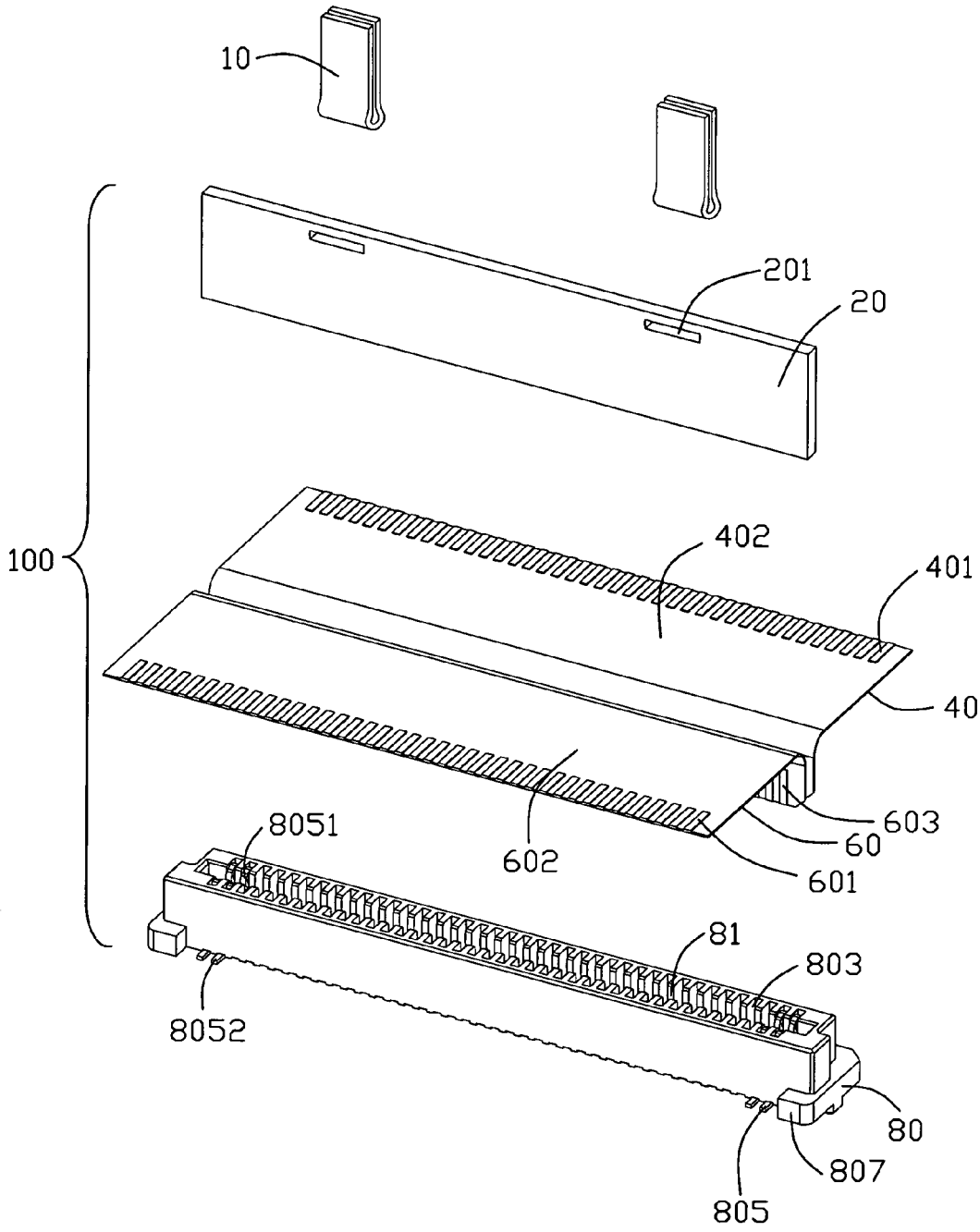
FIG. 3 is an exploded, perspective view of the electrical connector assembly shown in FIG. 1 and a pull tape which can attach to the electrical connector assembly.
Figure 4:
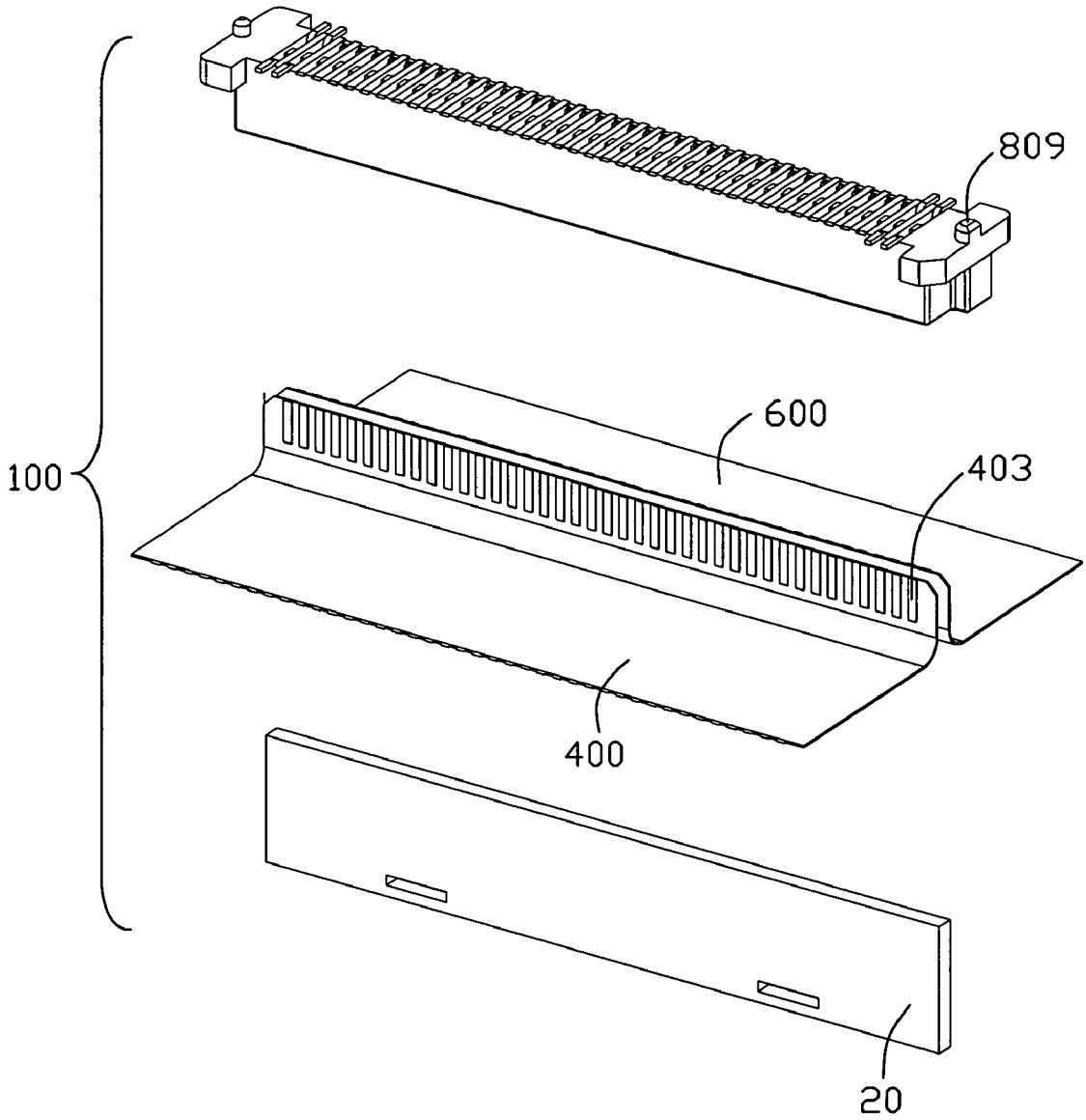
FIG. 4 is an exploded, perspective view of the electrical connector assembly shown in FIG. 2.

Referring to FIGS. 3 to 4, the board-mount connector defines an insulative housing 80 and a plurality of terminals 805 disposed in the insulative housing 80.

Referring to FIGS. 2 to 5, the insulative housing 80 defines a mating face and a mounting face opposite to the mating face. A receiving cavity 81 extends inwardly from the mating face of the insulative housing 80. The receiving cavity 81 is defined by a front wall, a rear wall and a pair of side walls connected with the front and rear wall. A plurality of terminal receiving passages 803 are defined in a pair of opposite inner faces of the front and rear walls and are in communicating with the receiving cavity 81. A plurality of terminals 805 are arranged into two rows and respectively received into the terminal receiving passages 803. The insulative housing 80 further defines a pair of base portions 807 disposed at two sides thereof and each has a bottom face aligning with the mounting face of the insulative housing 80. Each base portion 807 defines a positioning post 809 extending downward from the bottom face thereof for positioning the electrical connector assembly 100 to the PCB (not shown in the Figs.). A plurality of slots (not labeled) are penetrating a mounting face of the insulative housing 80 and communicating with the receiving cavity 81. The slots are spaced apart by a plurality of ribs 808 formed on the mounting face of the insulative housing 80.

Figure 5:
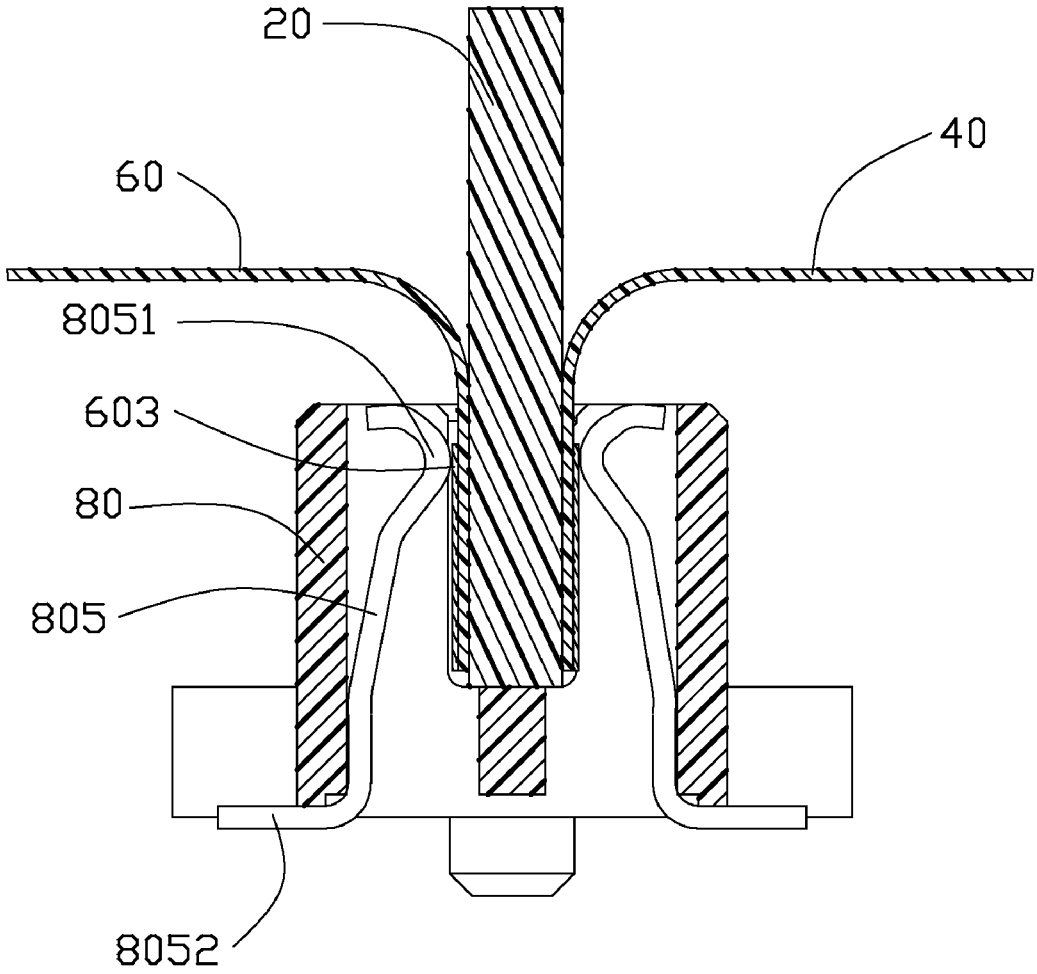
FIG. 5 is a cross section view of the electrical connector assembly of FIG. 1 taken along line 5-5.

Referring to FIGS. 3 and 5, a plurality of terminals 805 are inserted into the terminal receiving passages 803 of the insulative housing 80. Each terminal 805 has a contacting portion 8051 and a soldering portion 8052 perpendicular to the contacting portion 8051. Each contacting portion 8051 of the contact 805 is received into the terminal receiving passage 803. Each soldering portion 8052 of the contact 805 extends out of the terminal receiving passage 803 and attaches to the mounting face of the insulative housing 80.

Referring to FIGS. 1, 3 and 4, the FFC module 100 defines an insulative insert 20 and a pair of FFCs 40, 60 respectively attached to two opposite sides of the insulative insert 20.

The pair of FFCs 40, 60 comprises a first FFC 40 and a second FFC 60 having a same structure with the first FFC 40. Each FFC 40, 60 defines a plurality of conductors arranged side by side, and insulating films laminated on the both sides of the conductors. The first and second FFCs 40, 60 each has a first mating portion and a second mating portion at two ends thereof. The first and second FFCs 40, 60 each has a first face 400, 600 and a second face 402, 602 opposite to the first face 400, 600. The first mating portion of the first FFC 40 has a plurality of first contacting sections 403 exposed the first face 400 of the first FFC 40. The second mating portion of the first FFC 40 has a plurality of second contacting sections 401 exposed the second face 402 of the first FFC 40. The first and second contacting sections 403, 401 of the first FFC 40 are defined by two ends of the plurality of conductors of the first FFC 40. The first mating portion of the second FFC 60 has a plurality of first contacting sections 603 exposed the first face 600 of the second FFC 60. The second mating portion of the second FFC 60 has a plurality of second contacting sections 601 exposed the second face 602 of the second FFC 60. The first and second contacting section 603, 601 of the second FFC 60 are defined by two ends of the plurality of conductors of the second FFC 60.

The insulative insert 20 is formed of plastic material and defined by an upper half section with two holes 201 therein and a lower half section for supporting a pair first mating portions of the first and second FFCs 40, 60.

The first and second FFCs 40, 60 are integrally attached to the insulative insert 20 through adhesive. A pair of second faces 402, 602 of the first mating portions of the first and second FFCs 40, 60 are respectively attached and adhered to the two sides of the insulative insert 20. So the first contacting sections 403, 603 of the first mating portions of the first and second FFCs 40, 60 can contact with the contacting portions 8051 of the terminals 805. And a pair of second mating portions of the first and second FFCs 40, 60 can be used to mate with two complementary connectors. The FFC module defines an inserting portion formed by a pair of first mating portions of the first and second FFCs 40, 60 and a lower half section of the insulative insert 20 and disposed at one end thereof.

Referring to FIG. 3, a pull tape 10 can pass through the hole 201 to make the pull tape connected to the insulative insert 20. The pull tape 10 is used to pull the FFC module out of the receiving cavity 81 of the insulative housing 80. The first and second FFCs 40, 60 can be bent to make the first mating portion thereof angled with the second mating portion thereof.

As the first and second FFCs 40, 60 existed, the electrical connector assembly 100 can be connected with two complementary connectors. In addition, the first and second FFCs 40, 60 can be bent arbitrary so that the connection between the electrical connector assembly 100 and two complementary connectors will be easy and convenient.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

an insulative housing defining a receiving cavity extending inwardly from a mating face thereof and a plurality of terminal receiving passages disposed in the insulative housing and in communication with the receiving cavity;

a plurality of terminals received into the corresponding terminal receiving passages; and a FFC module configured with a pair of FFCs with a pair of first mating portions at one end thereof and an insulative insert having a lower half section disposed between the pair of first mating portions, the FFC module having an inserting portion received into the receiving cavity of the insulative housing;

and the insulative insert further having an upper section extending to an exterior and having at least one hole therein for a pull tape passing through.

2. The electrical connector assembly as recited in claim 1, wherein the first mating portions of the pair of FFCs are integrally adhered to the insulative insert.

3. The electrical connector assembly as recited in claim 1, wherein each terminal defines a contacting portion disposed in the terminal receiving passage and a soldering portion extending out of the terminal receiving passage and perpendicular to the contacting portion.

4. The electrical connector assembly as recited in claim 1, wherein the inserting portion is defined by a pair of mating portions of the pair of FFCs and the lower half section of the insulative insert.

5. The electrical connector assembly as recited in claim 4, wherein each FFC defines a plurality of conductors arranged side by side, and insulating films laminated on the both sides of the conductors.

6. The electrical connector assembly as recited in claim 5, wherein the inserting portion defines a plurality contacting sections exposed the insulating films and contacted with the terminals received into the insulative housing.

7. The electrical connector assembly as recited in claim 1, wherein the pair of FFCs further has a pair of second mating portions at another end thereof for mating with two complementary connectors.

8. The electrical connector assembly as claimed in claim 7, wherein the pair of second mating portions of the pair of FFCs are respectively angled with the pair of first mating portions of the pair of FFCs.

9. The electrical connector assembly as recited in claim 1, wherein the insulative housing further defines a pair of base portions disposed at two sides thereof, each base portion defines a positioning post extending downwardly from a mounting face opposite to the mating face thereof.

10. The electrical connector assembly as recited in claim 9, wherein a plurality of slots are penetrating a mounting face of the insulative housing and communicating with the receiving cavity.

11. The electrical connector assembly as recited in claim 10, wherein the slots are spaced apart by a plurality of ribs formed on the mounting face of the insulative housing.

12. An electrical connector assembly, comprising:

an insulative housing defining a receiving cavity recessed inwardly from a mating face thereof and a plurality of terminal receiving passages communicated with the receiving cavity;

a plurality of terminals received into the corresponding terminal receiving passages;

a first and second FFCs both having a first mating portion received in the cavity, each first mating portion having a plurality of conductors exposed and contacted with a plurality of terminals;

an insulative insert having a portion received into the receiving cavity and disposed between the first mating portions of the first and second FFCs, and another portion opposite to said portion and not secured to the FFC but exposed to an exterior for easy operation; and a pull tape secured to another portion of the insulative insert opposite to said portion.

13. The electrical connector assembly as recited in claim 12, wherein the insulative insert further defines a portion having a hole therein for a pull tape passing through.

14. The electrical connector assembly as recited in claim 12, wherein the first mating portions of the first and second FFCs are integrally adhered to the insulative insert.

15. The electrical connector assembly as recited in claim 14, wherein each first and second FFC further has a second mating portion at another end thereof respectively for mating with a complementary connector.

16. An electrical connector assembly comprising:

an insulative housing defining an elongated slot extending along a lengthwise direction;

two rows of contacts disposed by two sides of the slot in the housing;

a pair of discrete flat flexible cables (FFCs) each having a front mating region, the front mating regions of said pair of FFCs associated with an insulator sandwiched therebetween, commonly received in the slot to mechanically and electrically engage the corresponding contacts in respective rows; wherein a front edge region of the insulator is associatively secured between the pair of FFCs and is received in the slot while a rear edge region of the insulator is exposed to an exterior and a pull tape is attached to the rear edge portion of the insulator for easy operation.

17. The electrical connector assembly as claimed in claim 16, wherein said insulator, said connector and said pair of FFCs commonly defines cross like configuration in a view taken along the longitudinal direction.

* * * * *